United States Patent [19]

Hayashi et al.

[11] 4,040,946

[45] Aug. 9, 1977

[54] PROCESS FOR THE PRODUCTION OF A PETROLEUM COKE AND COKING CRYSTALLIZER USED THEREOF

[75] Inventors: Kiyoshige Hayashi, Tokyo; Mikio Nakaniwa, Ohme; Nobuyuki Kobayashi, Ichihara; Minoru Yamamoto, Ichihara; Yoshihiko Hase, Ichihara, all of Japan

[73] Assignee: Maruzen Petrochemical Co., Ltd., Tokyo, Japan

[21] Appl. No.: 614,675

[22] Filed: Sept. 18, 1975

[30] Foreign Application Priority Data

Sept. 26, 1974 Japan ..... 49-109966

[51] Int. Cl.[2] ..... C10G 9/14

[52] U.S. Cl. ..... 208/131; 208/46; 423/445

[58] Field of Search ..... 208/46, 106, 131; 423/445, 450

[56] References Cited

U.S. PATENT DOCUMENTS

| | | | |
|---|---|---|---|
| 2,366,057 | 12/1944 | Russell | 208/106 |
| 2,775,549 | 12/1956 | Shea | 208/131 |
| 2,921,017 | 1/1960 | Johnson et al. | 208/106 |
| 3,472,761 | 10/1969 | Cameron | 208/131 |
| 3,736,248 | 5/1973 | Hussong | 208/46 |
| 3,769,200 | 10/1973 | Folkins | 208/131 |

*Primary Examiner*—Herbert Levine

*Attorney, Agent, or Firm*—Larson, Taylor and Hinds

[57] ABSTRACT

A petroleum coke of unusually high-crystalline texture and of high purity is produced from a low-sulfur petroleum material by a process including a preheat-treating step for removing non-crystalline substances contained in the material as pitch or coke and a coking step wherein a heavy oil derived from the preceding step is coked in a coking crystallizer in such a manner that pitch-like heavy oil downwardly flows and is progressively accumulated and coked therein while gaseous light hydrocarbons are discharged at the upper part of crystallizer whereby the coking is conducted with a high growth and high orientation of coke crystals formed.

11 Claims, 6 Drawing Figures

Figure 1A:
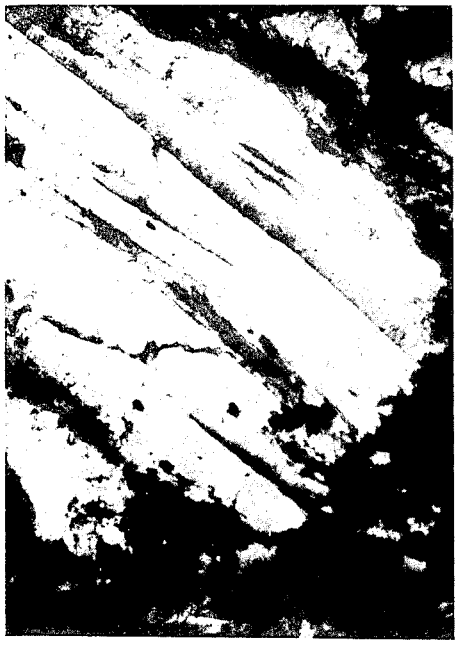

PROCESS FOR THE PRODUCTION OF A PETROLEUM COKE AND COKING CRYSTALLIZER USED THEREOF

This invention relates to a process for the production of petroleum coke of unusually high-crystalline texture and of high purity from a petroleum material including a low-sulfur virgin crude oil, distillation residuum derived therefrom such as topped or vacuum residuum and a low-sulfur cracked residuum derived from catalytic or thermal cracking of petroleum.

There are two types of coking process broadly classified, namely delayed coking and fluid coking, which have been utilized for large scale production of petroleum coke, both of which would be developed firstly with the intention of removing from topped or vacuum residua substances easily cokable by heating as coke thereby to provide liquid hydrocarbons, thus the coke being so to speak a by-product. Such a petroleum coke may, in most cases, be used as fuel in power plants and others like coal. However, certain of petroleum cokes of a high quality such as those produced from low-sulfur petroleum residua under limited contitions may be utilized in place of pitch coke derived from coal pitch. Thus, such a high-quality petroleum coke, so-called premium grade coke, is now holding more and more an important position as material for the production of graphite electrodes to be used in electric furnace smelting of aluminium and iron.

It is generally known that a coke suitable as material for the production of graphite electrodes to be used in electric furnace steel-making is characterized as a rule by having a low coefficient of thermal expansion (CTE) and a low electric resistivity, by showing diffraction bands due to the existence of crystals in X-ray diffraction and by having a crystalline texture well grown and oriented in one direction, i.e. so-called needle-like structure, in observation by naked eye or by microscope. It is also known that in order to produce such a coke of needle-like structure, the selection of starting petroleum heavy residue is most important, that is the starting material should be one containing little or less amount of non-crystalline carbon-forming substances (hereinafter referred to as non-crystalline substances) or one from which non-crystalline substances have been substantially removed by any appropriate treatment.

Recently, electric furnace steel-making has required ultra high power (UHP) operation in place of high power (HP) operation so far employed and this tendency has been more attractive in steel-making using iron pellets, whereupon requirement for the performance of graphite electrodes has necessarily become more severe. The quality of graphite electrodes primarily depends upon the quality of coke from which the electrodes are produced and thus the improvement in the quality of so-called premium grade coke is now essential and eagerly desired in the art.

The object of this invention is to provide a process and apparatus for the production of a petroleum coke of higher quality than the premium grade one so-called, with high reproducibility and stability on large scale, which is suitable as material for the production of graphite electrodes to be used in electric furnace steel-making under UHP operation.

There are various factors which have been considered as measures essential for evaluating the quality of coke to be suited for the production of graphite electrodes directed to the use in electric furnace steel-making under UHP operation. Thus, it is generally appreciated that the coke to be directed for such application should have a needle-like structure, a low coefficient of thermal expansion (CTE), a low electric resistivity and diffraction bands of crystals in X-ray diffraction, the value of CTE being the most important measure. Up to now, however, there is no testing method for determining each of the above-said factors which has been established or authorized and the assessments or interpretations of respective values thus determined have not necessarily accorded with one another. It is therefore believed that the qualification of petroleum cokes on the basis of the above-mentioned factors only is not necessarily reasonable.

In view of the fact that it is important for a measure or criterion of the quality of coke to indicate simultaneously not only the degree of thermal expansion but also the crushing strength of coke particles, crystal size, degree of orientation and the like, we have made many investigations to search for a new criterion by which the quality of coke to the directed to the production of electrodes may accurately be assessed and now found as such a criterion the value of maximum traversed magnetoresistance to be most suitable in addition to or in place of the value of CTE. Thus, the higher the value of maximum traversed magnetoresistance, the better the crystal growing, the degree of orientation and the layer stacking, all of which phenomena may decisively determine the quality of coke.

The maximum traversed mangetoresistance $(\Delta\rho/\rho)$ Tmax is defined as follows:

$$(\Delta\rho/\rho)\ T\max\% = (\rho H - \rho o/\rho o) \times 100$$

where $\rho o$ is electric resistivity free from a magnetic field and $\rho H$ is electric resistivity under a magnetic field. The conditions of the measurement are as follows:

Magnetic field: 10 Kgauss.

Temperature (liquid nitrogen): 77° K.

The magnetic field is applied in perpendicular direction to the sample. The details of the measurement are based on the method reported by Yoshihiro Hishiyama et, al in Japanese Journal of Applied Physics, 10, 4, 416–420 (1971).

It is known that the value of maximum traversed magnetoresistance is the highest in case of a single crystal graphite of zero defect with a constant magnetic field and decreases considerably with the increase in defect and that the value is independent of the shape of sample.

We have studied in detail on relations of maximum traversed magnetoresistance with coefficient of thermal expansion (CTE), coefficient of cubic expansion (CCE) and electric resistivity, all of which were measured on samples in the form of graphite artefact, and found that the lower the value of CTE, CCE and electric resistivity, the higher the value of maximum traversed magnetoresistance. Further, the observation of scanning electron photomicrographs and polarizing photomicrographs of these samples has shown that with the increase in the value of maximum transversed magnetoresistance, the crystalline texture of coke is of higher growth, of better orientation and of higher layer stacking. Thus, in view that the value of maximum traversed magnetoresistance has a good correspondence or correlativily with values of CTE, CCE and electric resistivity and also with the crystalline texture, we now propose to use this as reasonable criterion to evaluate the coke to be used for the production of graphite electrodes.

The measurement of maximum traversed magnetoresistance of coke was made on a sample prepared by calcining a green coke at 1400° C for 3 hours, pulverizing the calcined coke into particle size fractions of 35–65 mesh and 100 mesh plus, blending together 40 parts of 35–65 mesh fraction, 60 parts of 100 mesh plus fraction and 30 parts of coal tar pitch, kneading the mixture at 170° C, extruding the kneaded mass into a rod of 20 mm in diameter and 200 mm in length, baking the rod at 1000° C for 3 hours and then at 2700° C for 1 hour for graphitization and cutting samples of certain specific size and shape.

We have found that petroleum coke obtained according to the present invention as defined hereinafter has a value of maximum traversed magnetoresistance of higher than 16.0% when measured as above-specified and of higher than 50% when measured in the form of a graphitized coke prepared by graphitizing the calcined coke as such at 2700° C for 1 hour, and is of unusually high-crystalline texture and has a silvery white metallic luster in appearance and that such a coke is most suitable as material for the production of graphite electrodes to be used in electric furnace steel-making under UHP operations. As far as we know, such a high-crystalline petroleum coke is not commercially available as yet. The highest grade of petroleum coke commercially available which is so-called premium grade one has been found by our measurement to have a value of maximum traversed magnetoresistance of about 6–10%, while the so-called regular grade petroleum coke has been found to have said value of about 3–6%. For convenience, the relation between the maximum traversed magnetoresistance and coefficient of thermal expansion in the direction parallel to the extrusion of these types of petroleum coke measured in the form of a graphite artefact is given as follows:

| | Maximum traversed magnetoresistance (10 Kgauss, 77° K) | Coefficient of thermal expansion (over 100° - 400° C) |
|---|---|---|
| | % | x $10^{-6}$/° C |
| High-crystalline coke | Above 16 | Below 1.0 |
| Premium grade coke | 6 - 10 | 1.0 - 1.2 |
| Regular grade coke | 3 - 6 | Above 1.2 |

It is already known that in order to produce a high quality petroleum coke, that is so-called premium grade one which is suitable as material for the production of high quality graphite electrodes, the following are essentially required:

1. Starting material must be of a low sulfur content;
2. The content of light oil fractions and the amount of steam or inert vapour to be blown into coking drum for dilution of material should be as low as possible so that excessive agitation of the reaction mass is prevented during the reaction of delayed coking;
3. Starting material should be one containing little or less amount of non-crystalline substances or one from which non-crystalline substances have been substantially removed by an appropriate treatment.

As a result of many investigations on important factors of petroleum coke for being suited as material for the production of high quality graphite electrodes, we have found that the most important, fundamental requisite for petroleum coke in question is to have a crystalline texture highly grown and oriented in one direction with a minimum content of non-crystalline substances and of foreign matters and that to produce such a high-crystalline coke it is most important to carry out the coke-forming reaction under such conditions that the formation and growth of coke crystals are conducted with a minimum agitation or disturbance of the reaction system whereby the growth and orientation of coke crystals formed are promoted.

There have already been proposed various processes for the removal of non-crystalline substances from petroleum materials with the intention of producing a premium grade or higher grade petroleum coke, for example a process wherein the petroleum material is preheat-treated in the presence or absence of a catalyst followed by removing a part of the material before coking and a process wherein the petroleum material is subjected to delayed coking in two stages, but as far as we know such a high quality coke as one obtained by the present invention, named a high-crystalline coke, has never been obtained as yet, possibly due to the difficulty of achieving complete and efficient removal of non-crystalline substances before coking.

We have further paid attention to disadvantages of delayed coking method itself for the purpose of producing such a high-crystalline coke. As is well-known, according to delayed coking method, a petroleum feedstock which has been heated to a temperature required for the coking is fed in at the bottom of a heat-insulated coking drum and maintained therein to effect the formation of coke. In this method, the coking reaction involving cracking, polymerization and condensation is effected under such conditions that pitch-like heavy oil being formed therein in stirred, diluted and contaminated by freshly charged material and by light oil formed by the cracking of heavy oil during the coking, namely under the conditions of notable agitation or disturbance occurring in the drum, thus difficulties are brought in achieving the growth and orientation of coke crystals formed. Furthermore, the quality of coke formed varies with its position in the coking drum because the freshly charged material is passed upwardly through the coke already formed in the coking drum, during which pass the fresh charge is coked to some extent and thus the concentration of coke is higher at the lower part of the drum and lower at the higher part of the drum. As a rule, the coke obtained at lower part of drum has better mechanical strength but worse CTE than those of coke obtained at higher part of drum. Thus, we came to a conclusion that the delayed coking system is not suitable for the purpose of producing a high-crystalline petroleum coke even when a well-selected starting material is used owing to difficulties in the prosecution of coking reaction under ideal conditions.

Under the circumstances, we have intended to provide a new method for the removal of non-crystalline substances from starting materials and new type of coking drum which makes it possible to carry out the coking reaction involving the formation, growth and orientation of coke crystals under the conditions of a high concentration of coke-forming substances and of a minimum agitation of the reaction system. For the removal of non-crystalline substances, we have investigated in detail on influences of nature of starting materials and coking reaction conditions including temperature, pressure and time on the yield and properties of coke obtained and, for the structure of coking drum, on the elimination of agitation or disturbance of the reaction system due to the introduction of fresh feed and convection flow which would result in the prevention of the growth and orientation of coke crystals. This invention is the combination of the results of these investigations.

According to one aspect of this invention, therefore, there is provided a process for the production of a petroleum coke of unusually high-crystalline texture and of a high purity from a petroleum starting material having a low sulfur content selected from the group consisting of a low-sulfur, virgin crude oil, distillation residuum, cracked residuum and their equivalent which comprises the steps of:

subjecting the starting material to heat treatment to remove non-crystalline substances contained therein as pitch or coke;

heating a heavy oil fraction of the startng material derived from the preceding stage, if necessary after removing a lighter fraction or fractions therefrom, to a temperature required for the subsequent coking; and continuously introducing the preheated oil with downward injection into a vertical, pressure coking-crystallizer, which is provided with a heating jacket surrounding the body thereof, an injection nozzle pipe at the upper part thereof for downwardly injecting the preheated oil and an injection nozzle at the lower part thereof for upwardly injecting a purging gas, where gaseous light hydrocarbons formed either by evaporation or by reactions of the oil introduced are discharged through an outlet positioned at the upper part of the crystallizer and the remaining pitch-like heavy oil downwardly flows and is progressively accumulated and coked under the given conditions of temperature and pressure, while a small amount of heated gas selected from steam, gaseous hydrocarbons and inert gas is introduced therein with upward injection at a slow rate capable of preventing the clogging of the gas injection nozzle, thereby conducting the coking with a high growth and high orientation of coke crystals formed.

By the term "unusually high-crystalline texture" used with respect to the petroleum coke obtained according to this invention is meant for the coke to have a higher crystalline texture than that of so-called premium grade or needle-like coke, both in the growth and in the orientation of coke crystals, and by the term "high purity" is meant that the contents of foreign matters and of non-crystalline substances are minimized.

The petroleum starting material should be one having a low sulfur content. For a virgin crude oil, usually, the sulfur content should be 0.4% by weight or less, preferably 0.25% or less. Distillation residuum should be one derived from a low-sulfur virgin crude oil as above-mentioned. For a cracked residuum, the sulfur content should preferably be 0.8% or less. Distillation and cracked residua containing a higher amount of sulfur may if desired be used after they are subjected to hydro-desulfurization to lower the sulfur content to a required level. Any other refinery residuum equivalent to those mentioned above may be used, if desired.

The heat treatment which constitutes the first stage of the process of this invention may be effected by any desired method capable of separating and removing non-crystalline substances contained in the starting material as pitch or coke. One method particularly effective for this purpose is to heat and maintain the starting material in a tube heater under certain controlled conditions for an appropriate time thereby to cause cracking and soaking of the material and then to subject the material to flash distillation or coking to remove selectively non-crystalline substances therefrom as pitch or coke. The conditions of such a heat treatment depend primarily upon the nature of starting material. Our experiments have shown that in most cases desired results can be obtained by heating the starting material in a tube heater to a temperature of 430°–520° C under a pressure of 4–20 $Kg/cm^2G$ followed by maintaining the same therein at this temperature for 30–500 seconds. We have further found found that the presence of a small amount, preferably 0.5–10% by weight, of a hydroxide and or a carbonate of an alkali or alkaline-earth metal in the starting material much more improves the efficiency of the separation of non-crystalline substances from the material in the heat-treatment stage according to this invention particularly when the starting material is a heavy oil or residuum and as a result the coke obtained has a value of maximum traversed magnetoresistance higher than 21% in the form of graphite artefact and a value higher than 60% in the form of graphitized coke.

According to another aspect of the present invention, there is provided a coking-crystallizer comprising a body in which a petroleum material is coked, a heating jacket surrounding the body through which a heating medium is circulated to provided a heat required for the body in a controlled manner, an injection nozzle pipe introduced into the body at the upper part thereof to downwardly inject a petroleum material to be coked, a purging gas injection nozzle introduced into the body at the lower part thereof to upwardly inject a purging gas, an outlet for discharging gaseous hydrocarbons formed and the purging gas at the upper part of the body and outlets for discharging coke formed at the top and bottom of the body.

We named the coking drum of this invention as coking-crystallizer because it makes possible to achieve unusually high growth and orientation of coke crystals.

In operation, of the heavy oil fraction introduced into the coking-crystallizer, gaseous hydrocarbons may be discharged at the upper part through an outlet therefor with a minimum agitation inside of the body, named coking zone, and the remaining heavy hydrocarbons downwardly flow in the coking zone and are progressively accumulated and coked therein in a high concentration. Thus, the agitation and disturbance which may occur owing to the release of cracked light hydrocarbons during the coke-forming reactions and to the introduction of the material may be minimized, and the coking reactions are conducted under well-controlled, optimum conditions so that the formation and growth of coke crystals regularly and progressively proceed in upward direction along the vertical axis of the crystallizer. As a result, the variation in quality of coke with the variation in positions thereof in the crystallizer can be minimized.

The inside temperature of coking-crystallizer may be well-controlled to a desired level by circulating a heating medium through the heating jacket of the crystallizer as required. A purging gas injection nozzle is inserted at the lower part of crystallizer, as above-described, to expel uncoked oil and cracked light oil fractions from the crystallizer after the completion of the coking reactions. In order to prevent the said injection nozzle from being clogged during the coking reactions, it is necessary to pass continuously therethrough a small amount of a heated gas such as steam, gaseous hydrocarbons and inert gas at such a slow rate that the agitation of coking zone is minimized but the clogging of said nozzle is avoided.

The coke obtained according to the process of this invention is of significantly higher quality than that of any of petroleum cokes hitherto publicly reported as above-mentioned, and is particularly characterized by its valves of maximum traversed magnetoresistance of higher than 16.0% measured at 10 Kgauss and 77° K in the form of graphite artefact and of higher than 50% measured at the same conditions in the form of graphitized coke.

The observation of the crystalline texture of coke obtained according to this invention in the form of a graphitized coke by a scanning electron microscope and a polarizing microscope has confirmed such a better quality of coke obtained according to the present process.

Figure 1B:
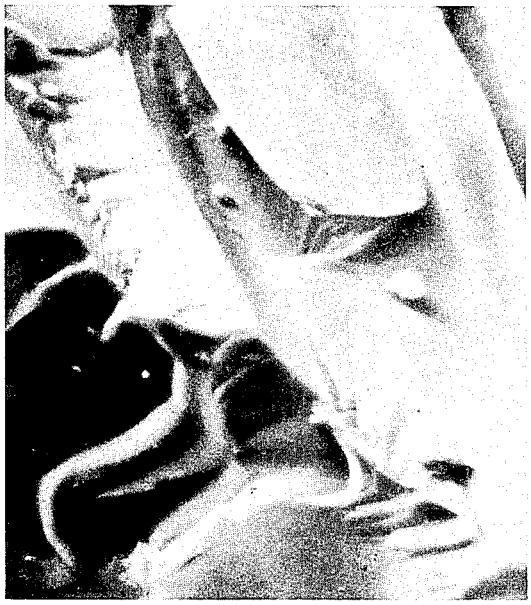

In the drawings attached herewith,

FIG. 1*a* is a reproduction of a polarizing photomicrograph taken at 250 times magnification of a graphitized coke obtained by this invention;

FIG. 1*b* is a reproduction of a scanning electron photomicrograph taken at 1000 times magnification of the same coke as that of FIG. 1*a;*

Figure 2A:
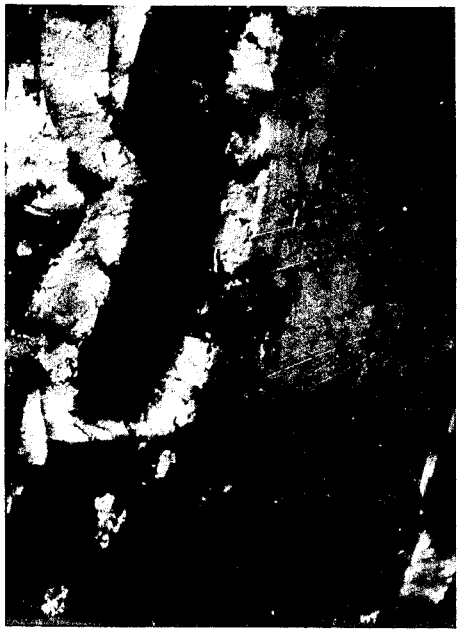
Figure 2B:
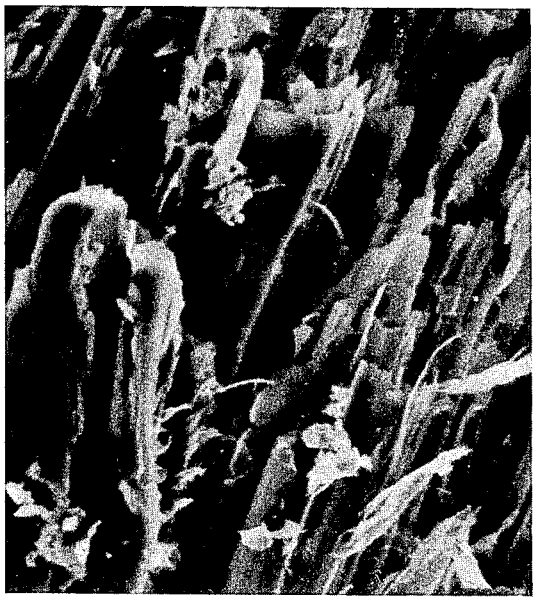

FIG. 2*a* is a reproduction of a polarizing photomicrograph taken at 250 times magnification of a graphitized coke of a typical premium grade petroleum coke commerically available;

FIG. 2*b* is a reproduction of a scanning electron photomicrograph taken at 1000 times magnification of the same coke as that of FIG. 2*a;*

Figure 3:
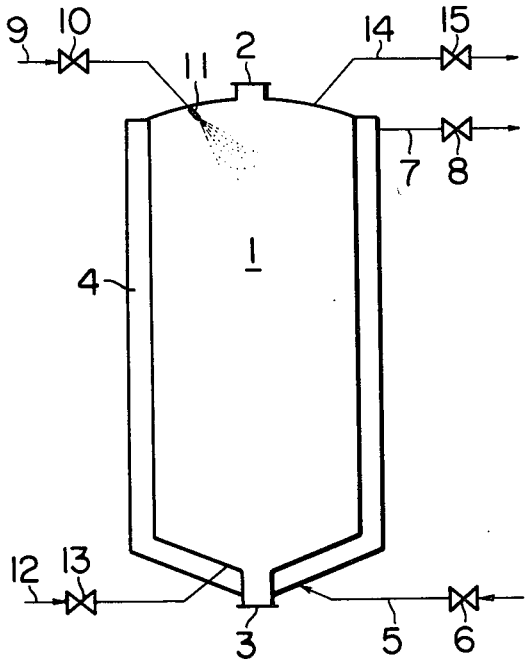
Figure 4:
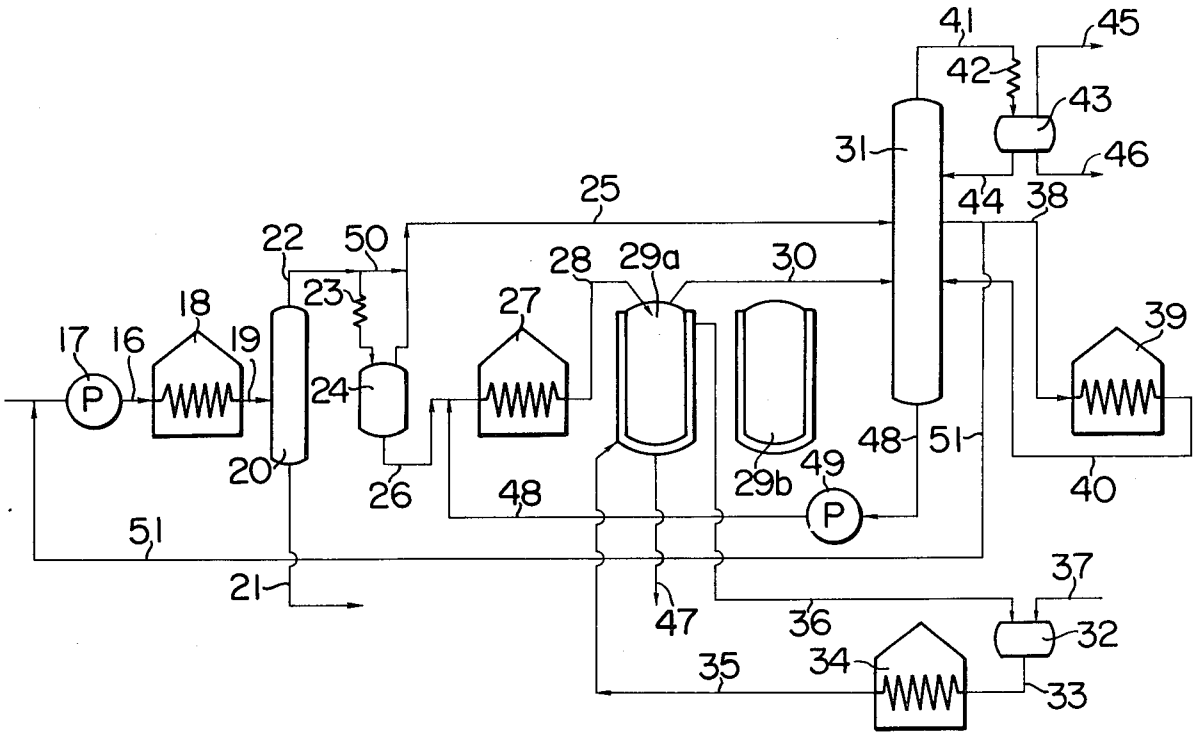

FIG. 3 is a sketch of a longitudinal section of one typical embodiment of the coking-crystallizer according to this invention; and FIG. 4 is a representative flow diagram of one specific embodiment of the process according to this invention.

Typical properties of coke obtained by the process of this invention are shown in Table 1 and by way of comparison properties of a typical premium grade coke commercially available are shown in Table 2.

Table 1

| Properties of coke obtained by this invention | |
|---|---|
| Graphite artefact | |
| Graphitization condition | 2700° C × 1 hr |
| Coefficient of thermal expansion in the direction parallel to the extrusion (CTE) | |
| 25–125° C | $0.25 \times 10^{-6}$/° C |
| 100–400° C | $0.83 \times 10^{-6}$/° C |
| Coefficient of cubic expansion (CCE) | |
| 130–300° C | $6.63 \times 10^{-6}$/° C |
| Maximum traversed magnetoresistance | 18.0% |
| Calcined coke | |
| Calcination condition | 1400° C × 3 hr |
| Real density | 2.170 g/cc |
| Crushing strength | 61.8% |
| Water content | 0.05 wt% |
| Ash content | 0.05 wt% |
| Volatile matter content | 0.43 wt% |
| Fixed carbon content | 99.47 wt% |
| Sulfur content | 0.45 wt% |
| Metal content | |
| Fe | 6 wt ppm |
| Ni | 3 wt ppm |

Table 1-continued

| Properties of coke obtained by this invention | |
|---|---|
| V | 4 wt ppm |
| Cu | 6 wt ppm |

Table 2

| Properties of a premium grade coke | |
|---|---|
| Graphite artefact | |
| Graphitization condition | 2700° C × 1 hr |
| Coefficient of thermal expansion in the direction parallel to the extrusion (CTE) | |
| 25–125° C | $0.65 \times 10^{-6}$/° C |
| 100–400° C | $1.20 \times 10^{-6}$/° C |
| Coefficient of cubic expansion (CCE) | |
| 130–300° C | $10.7 \times 10^{-6}$/° C |
| Maximum traversed magnetoresistance | 6.4% |
| Calcined coke | |
| Calcination condition | 1400° C × 3 hr |
| Real density | 2.124 g/cc |
| Crushing strength | 58.2% |
| Water content | 0.07 wt% |
| Ash content | 0.07 wt% |
| Volatile matter content | 0.44 wt% |
| Fixed carbon content | 99.42 wt% |
| Sulfur content | 0.23 wt% |
| Metal content | |
| Fe | 15 wt ppm |
| Ni | 11 wt ppm |
| V | 4 wt ppm |
| Cu | 10 wt ppm |

The crushing strength was determined by the following procedure:

About 30 g of calcined coke grist of 5 to 12 mesh size were put into a cylindrical mold made of stainless steel, 30 mm I.D. by 100 mm long. After setting a cylindrical piston head to contact with the top surface of the coke grist, a load up to a pressure of 100 Kg/cm²G was applied thereto for 30 seconds and the load was kept for further 30 seconds. The coke grist was then taken out of mold and sieved out 12 mesh minus. The remaining coke grist was weighed. The ratio of the remaining coke grist to the original one is expressed as crushing strength in percent by weight.

The structure and method of operation of one typical embodiment of the coking-crystallizer according to this invention are now explained by referring to FIG. 3. A heavy oil for coking which has been heated to 450°–550° is continuously introduced through line 9 and valve 10 at the upper part of coking-crystallizer 1 provided with heating jacket 4 by means of injection nozzle pipe 11, the coking-crystallizer being maintained at 410°–500° C and 4–20 kg/cm²G. In the coking-crystallizer, gaseous light hydrocarbon fraction is discharged through line 14 and valve 15 and pitch-like heavy oil fraction downwardly flows and progressively accumulates therein with the proceeding of coking reaction. The lower part of the crystallizer is provided with purging steam line 12 with valve 13 through which a small amount of steam, gaseous hydrocarbon or an inert gas such as nitrogen heated to 400°–500° C is introduced into the crystallizer to prevent the clogging of line 12. When the level of the accumulated coke reaches near the nozzle 11, the introduction of the heavy oil through line 9 is stopped and the amount of high temperature steam through line 12 is increased to expel the remaining oily hydrocarbons from the crystallizer. On completion of the expulsion, flanges 2 and 3 are opened, through which coke formed is discharged. Any heating medium may be used provided it can maintain the temperature of the interior of crystallizer to 410°–500° C, for example molten salt, steam and hydrocarbons such as gaseous hydrocarbons discharged from the crystallizer. The heating medium is introduced through line 5 with valve 6 into the jacket 4 and discharged through line 7 with valve 8 therefrom. As a matter of course, the heating jacket 4 is covered with a heat-insulating material to minimize the radiation of heat.

One embodiment of the process according to this invention is illustrated by referring to FIG. 4. The starting petroleum material is pumped by means of pump 17 and introduced through line 16 into heater 18 for preheat-treating the same, where it is heated to 430°–520° C under 4–20 kg/cm²G and then maintained therein at that temperature for 30–500 seconds thereby to effect cracking and heat-soaking of the same. The material thus heat-treated is passed through transfer line 19 into high-temperature flashing column 20 of which upper trays have been packed with wire mesh blanket and the like to prevent pitch being entrained with distillate during the flash distillation. The pitch having a softening point of 100°–240° C is discharged from the bottom of column through line 21 by means of pump in a molten state while the bottom temperature being maintained at 380°–480° C under a pressure of 2–10 kg/cm²G. At the same time, the flash-distillate is discharged at the head of column through line 22 and passed through cooler 23 into drum 24 wherein condensed oil is held while non-condensed gaseous hydrocarbon fraction is passed through line 25 into main fractionating column 31 at the middle part thereof. Alternatively, all the flash-distillate may be directly introduced through lines 50 and 25 into main column 31. The condensed oil is then pumped through line 25 into coking preheater 27 where it is heated to 450°–550° C and injected through line 28 into coking-crystallizer **29*a* at the head thereof. In the coking-crystallizer, gaseous light hydrocarbons formed either by evaporation or by cracking and polycondensation of pitch-like heavy oil as well as a small amount of steam (or gaseous hydrocarbons or inert gas) are discharged at the head of crystallizer through line 30 and introduced into the main fractionating column 31 at a lower position than that of line 25. Heating medium is continuously circulated through the outer jacket of the crystallizers 29*a* and 29*b* to keep the inside temperature of crystallizers to 40°–500° C by passing the heating medium from line 37 through drum 32, line 33, heater 34, line 35 and line 36 back to drum 32. This circulation is for a molten salt as heating medium. If super heated steam is used as heating medium, more simple system may be used. Alternatively, gaseous light hydrocarbons coming from line 22 (450°–550° C) or from line 30 (430°–520° C) may be used as heating medium for coking crystallizer. When the coking-crystallizer 29*a* is filled with coke formed, the introduction of the heavy oil charge is switched over into the crystallizer 29*b* and the green coke accumulated in the crystallizer 29*a* is discharged. A distillate boiling above 200° C taken from the middle part of main column 31 as side-cut is passed through line 38 into heater 39 where a heat treatment at 500°–550° C under pressure is effected to form a tar and then returned through line 40 to the main column at lower part than that of line 38. At the bottom of main column 31, the bottom residue rich in tar is discharged by pump 49 and introduced through line 48 into coking preheater 27 in combination with the condensate of flash-distillate coming from line 26. Gas and gasoline fractions discharged at the top of main column 31 are passed through line 41 and cooler 42 into receiver 43 where the separation of gas and liquid is effected, the gas being discharged through line 45 and the liquid being discharged through lines 44 and 46 as reflux of the main column and as product, respectively. In some cases, a part of side-cut 38 from the main column may be combined through line 51 with the suction side of pump 17** for the dilution of starting material.

The following Examples further illustrate, but not limit, this invention, in which percentages are by weight unless otherwise specified.

EXAMPLE 1

A cracked residue containing 0.76% of sulfur named as tar-bottom which was obtained as by-product in a conventional thermal cracking of gas oil for the production of ethylene and which has properties shown in Table 3 was used as feedstock for this Example.

The feedstock was introduced into a tube heater having 4 mm inside diameter, 6 mm outside diameter and 20 m length, heated under a pressure of 4 kg/cm²G to 490° C and maintained therein at this temperature of about 260 seconds. The feedstock was then introduced into a high-temperature flashing column maintained at 490° C, where flash distillation of the feedstock is effected to recover distillate at the head of column and to withdraw pitch at the bottom of column in an amount of 20% based on the feedstock, with a retention time of about 10 minutes at the bottom of column, together with gas generated in an amount of 5.0% on the same basis. The distillate was then passed through a tube heater having 4 mm inside diameter, 6 mm outside diameter and 4 m length to preheat it to 450° C and then injected under a pressure of 9.0 kg/cm²G into a jacketed coking-crystallizer as shown in FIG. 3 at the top thereof, wherein pitch-like heavy oil was progressively accumulated and coked while light, uncoked hydrocarbons were discharged at the head of crystallizer.

The yield of coke was 46.2% based on the charge of crystallizer (34.9% based on the starting feedstock). By-products of the coking stage were 18.1% (13.6%) of cracked gas, 1.1% (0.8%) of gasoline boiling up to 200° C, 28.9% (21.6%) of gas oil boiling in the range 200°–300° C and 5.7% (4.3%) of heavy oil boiling 300° C+.

The properties of coke obtained are shown in Table 4. Particularly noticeable were CTE of $0.83 \times 10^{-6}$/°C over 100°–400° C, CCE of $6.63 \times 10^{-6}$/°C over 130°–300° C and maximum traversed magnetoresistance of 18.0% measured all in the form of a graphite artefact. The coke was of unusually high-crystalline texture and apparently superior to premium grade one.

EXAMPLE 2

A hydrodesulfurized product containing 0.3% of sulfur (named as desulfurized tar) of a cracked residue containing 1.05% of sulfur which was obtained as by-product in a conventional thermal cracking of gas oil for the production of ethylene was used as feedstock for this Example. The properties of the desulfurized tar are shown in Table 3.

The feedstock was treated in the same apparatus, in the same manner and under the same conditions as those used in Example 1. At the flash distillation stage, pitch was removed in an amount of 7.8% based on the feedstock together with gas generated in an amount of 0.8% on the same basis.

The yield of coke was 22.8% based on the charge of crystallizer (20.9% based on the starting feedstock).

By-products of the coking stage were 13.1% (12.0%) of cracked gas, 1.9% (1.7%) of gasoline boiling up to 200° C, 53.2% (48.6%) of gas oil boiling in the range 200°-300° C and 9.0% (8.2%) of heavy oil boiling 300° C+.

The properties of coke obtained are shown in Table 4. The coke was of unusually high-crystalline texture and apparently superior to premium grade one.

EXAMPLE 3

The gas oil (200°-300° C) fraction ) named as coker gas oil which was obtained as by-product in the coking stage of Example 2 and which has properties shown in Table 3 was introduced at a rate of 1 kg/hr into a tube heater having 4 mm inside diameter, 4 mm outside diameter and 40 m length and thermally cracked therein under the conditions of 530° C and 65 kg/cm²G, the heavy residue boiling 300° C+ being taken out as thermal tar and the unreacted oil being recycled to the thermal cracking. Thus, there were obtained 33.5% of cracked gas 29.9% of gasoline boiling up to 200° C and 36.6% of thermal tar boiling 300° C+, based on the starting gas oil.

The thermal tar thus obtained was introduced into the coking-crystallizer as used in Example 1 and coked under the same conditions as those of Example 1, yielding 47.3% of coke and as by-products 23.1% of cracked gas and 29.6% of cracked oil based on the thermal tar.

The properties of coke obtained are shown in Table 4. The coke was of unusually high-crystalline texture and superior to premium grade one.

EXAMPLE 4

The procedure of Example 1 was repeated except that 0.5% based on the feedstock of sodium hydroxide were mixed with the feedstock before treatment in the form of an aqueous solution. At the flash distillation stage, pitch was removed in an amount of 29.0% together with 1.1% of gas. The coking stage gave a coke in a yield of 47.3% based on the thermal tar (24.2% based on the starting feedstock) and as by-products 15.2% (10.6%) of cracked gas and 50.3% (35.1%) of cracked oil.

The properties of coke obtained are shown in Table 4. The coke was of unusually hIgh-crystalline texture and superior to premium grade one.

EXAMPLE 5

A topped residue of Minas crude oil which has properties shown in Table 3 was used as feedstock for this Example.

The feedstock was introduced into a tube heater having 4 mm inside diameter, 6 mm outside diameter and 40 m length and heated under 20 kg/cm²G to 480° C and maintained therein at this temperature for about 190 seconds. The feedstock thus heat-treated was introduced into a high-temperature flashing column and subjected to flash distillation under conditions of 400° C and 0 kg/cm²G to recover distillate at the top of column and to withdraw pitch at the bottom of column in an amount of 10.7% based on the feedstock, with a retention time of about 15 minutes at that bottom, together with gas generated in an amount of 21.0% on the same basis. The distillate (68.3% based on the feedstock) was passed through a tube heater same as that used in Example 1 to preheat it to 450° C and then injected under a pressure of 9 kg/cm²G into a jacketed coking-crystallizer as used in Example 1 at the top thereof, wherein pitch-like heavy oil was gradually and increasingly accumulated and coked, while light, uncoked hydrocarbons were discharged at the head of crystallizer.

The yield of coke was 5.9% based on the charge of crystallizer (4.1% based on the starting feedstock). By-products of the coking stage were 18.2% (12.4%) of cracked gas, 20.0% (13.6%) of gasoline boiling up to 200° C, 34.5% (23.6%) of gas oil boiling in the range 200°-300° C and 21.4% (14.6%) of heavy oil boiling 300° C+.

The properties of coke obtained are shown in Table 4. The coke was of unusually high-crystalline texture and superior to premium grade one.

EXAMPLE 6

Djatibarang virgin crude oil which has properties shown in Table 3 was used as feedstock for this Example.

The feedstock was introduced into a tube heater having 4 mm inside diameter, 6 mm outside diameter and 40 m length and heated under 18 kg/cm²G to 480° C and maintained therein at this temperature for about 300 seconds. The feedstock thus heat-treated was introduced into a coking drum having 100 mm diameter and 1000 mm height which was externally heated by electric wire heater and coked therein at 415° C under 3 kg/cm²G to remove non-crystalline substances contained in the feedstock as coke. The amount of coke formed at this stage was 11.0% by weight based on the feedstock and simultaneously cracked gases were generated in an amount of 10.8% on the same basis.

The distillate from this coking stage (78.2% based on the feedstock) was introduced into a tube heater having 4 mm inside diameter, 6 mm outside diameter and 4 m length to heat it to 440° C at the outlet thereof and then injected under a pressure of 10 kg/cm²G into a jacketed coking crystallizer as used in Example 1 at the top thereof, wherein pitch-like heavy oil was gradually and increasingly accumulated and coked, while light, uncoked hydrocarbons were discharged at the head of crystallizer.

The yield of coke formed in the crystallizer was 11.2% based on the charge of crystallizer (8.8% based on the feedstock). The properties of coke thus obtained are shown in Table 4. The coke was of unusually high-crystalline texture and superior to premium grade one.

Table 3

| | Tar-bottom (Example 1) | Desulfurized tar (Example 2) | Coker gas oil (Example 3) | Minas topped residue (Example 5) | Djatibarang virgin crude oil (Example 6) |
|---|---|---|---|---|---|
| Specific gravity (15°/4° C) | 1.0825 | 1.028 | 0.9723 | 0.883 | 0.885 |
| Carbon residue (wt %) | 17.7 | 6.7 | 0 | 4.5 | 8.9 |
| Sulfur content (wt %) | 0.76 | 0.3 | 0.18 | 0.22 | 0.17 |
| Wax content (wt %) | — | — | 0 | 36.8 | 33.6 |
| Pour point (° C) | +20 | <−30 | <−30 | +47.5 | +45 |
| Composition | | | | | |
| Paraffin content (vol %) | 5.6 | 16.5 | — | 64.1 | 62.0 |
| Aromatics content (vol %) | 88.7 | 81.3 | — | 31.0 | 24.6 |

Table 3-continued

| | Tar-bottom (Example 1) | Desulfurized tar (Example 2) | Coker gas oil (Example 3) | Minas topped residue (Example 5) | Djatibarang virgin crude oil (Example 6) |
|---|---|---|---|---|---|
| Resin content (vol %) | 1.5 | 0.6 | — | 0.5 | 0.5 |
| Residue (vol %) | 4.2 | 1.6 | — | 4.4 | 12.9 |
| Distillation | | | | | |
| I.B.P. ° C | 220 | 195 | 223 | | 95 |
| 5% | 245 | 237 | 235 | | 180 |
| 10% | 260 | 250 | 239 | | 240 |
| 50% | 345 | 324 | 260 | | 369 |
| 90% | — | — | 295 | | — |
| E.P. | 465 | 513 | 317 | | 378 |
| | (88%) | (85%) | (98%) | | (65%) |

Table 4

| | Example 1 | Example 2 | Example 3 | Example 4 | Example 5 | Example 6 |
|---|---|---|---|---|---|---|
| Graphite artefact | | | | | | |
| Graphitization condition (2700° C × 1 hr) | | | | | | |
| Coefficient of thermal expansion in the direction parallel to the extrusion (CTE) (× $10^{-6}$/° C) | | | | | | |
| 25–125° C | 0.25 | 0.19 | 0.18 | 0.01 | 0.25 | 0.18 |
| 100–400° C | 0.83 | 0.76 | 0.78 | 0.67 | 0.80 | 0.79 |
| Coefficient of cubic expansion (CCE) (× $10^{-6}$/° C) | | | | | | |
| 130–300° C | 6.63 | 6.60 | 6.84 | 6.44 | 7.05 | 7.01 |
| Maximum traversed magneto-resistance (%) | 18.0 | 19.9 | 18.5 | 21.4 | 17.5 | 19.5 |
| Calcined coke | | | | | | |
| Calcination condition (1400° C × 3 hr) | | | | | | |
| Real density (g/cc) | 2.170 | — | 2.152 | 2.166 | — | — |
| Crushing strength (%) | 61.8 | 57.3 | 59.0 | 60.5 | 64.7 | 57.3 |
| Water content (wt.%) | 0.05 | 0.04 | 0.06 | 0.10 | 0.07 | — |
| Ash content (wt.%) | 0.05 | 0.05 | 0.05 | 0.05 | 0.05 | — |
| Volatile matter content (wt.%) | 0.43 | 0.25 | 0.16 | 0.32 | 0.30 | — |
| Fixed carbon content (wt.%) | 99.47 | 99.66 | 99.73 | 99.52 | 99.58 | — |
| Sulfur content (wt.%) | 0.45 | 0.30 | 0.66 | 0.45 | 0.25 | — |
| Metal content (wt ppm) | | | | | | |
| Fe | 6 | 6 | 35 | 20 | 25 | — |
| Ni | 3 | 3 | 2 | 1 | 1 | — |
| V | 4 | 4 | 3 | 2 | 3 | — |
| Cu | 6 | 6 | 3 | 5 | 5 | — |

EXAMPLE 7

This Example illustrates the superiority of the coking-crystallizer system of this invention to the delayed coking system.

The same charge as that introduced into the coking-crystallizer in Example 2 was used for the comparative runs of this Example.

In the first run, the charge, i.e. the distillate from the flash distillation stage of Example 2, was preheated to 450° C in a tube heater having 4 mm inside diameter, 6 mm outside diameter and 4 m length and then injected under a pressure of 9 kg/cm²G into a jacketed coking-crystallizer as used in Example 1 at the top thereof, wherein pitch-like heavy oil was gradually and increasingly accumulated and coked, while light, uncoked hydrocarbons were discharged at the head of crystallizer.

In the second run, the charge was preheated in the same manner as that of the first run and was introduced into a conventional delayed coking drum and coked therein.

The results of the two runs are shown in Table 5.

The comparison of the results clearly shows a significant improvement in properties of coke of the first run (according to this invention) over the second run (according to the delayed coking process), particularly with respect to CTE, CCE and maximum traversed magneto-resistance.

Table 5

| | Coking-crystallizer system of this invention (Run 1) | Delayed coking system (Run 2) |
|---|---|---|
| Yield of coke (wt.%) | 20.9 | 18.9 |
| Yield of cracked oil (wt.%) | 58.5 | 70.7 |
| Properties of coke | | |
| Graphite artefact | | |
| CTE (× $10^{-6}$/° C) | | |
| 25–125° C | 0.19 | 0.34 |
| 100–400° C | 0.76 | 1.06 |
| CCE (× $10^{-6}$/° C) | | |
| 130–300° C | 6.55 | 7.66 |
| Maximum traversed magnetoresistance (%) | 19.9 | 12.1 |
| Calcined coke | | |
| Crushing strength (%) | 63.8 | 56.3 |

EXAMPLE 8

This Example illustrates a further comparison between the coking-crystallizer system of this invention and the delayed coking system particularly to assess the variation in quality of coke with its position along the height of coking drum.

The procedures of the first and second runs of Example 7 were repeated using the same charge.

The properties of cokes obtained in the two runs were determined for each of test items on coke samples taken from the upper, middle and lower parts of coking drums. Results are shown in Table 6.

The results clearly show that the variation in quality of coke with the variation in positions thereof in coking drum is much less in the coking-crystallizer system of this invention than in the delayed coking system. Thus, for CTE over 100°-400° C the former shows a dispersion of only 0.05-0.06 $\times 10^{-6}$/°C, whereas the latter of 0.11-0.17 $\times 10^{-6}$/°C. For maximum traversed magnetoresistance, the former has a dispersion of only 0.1-0.4%, whereas the latter of 1.3-2.2%.

Table 6

| Position of sampling | Coking-crystallizer system of this invention (Run 1) | | | Delayed coking system (Run 2) | | |
|---|---|---|---|---|---|---|
| | Upper | Middle | Lower | Upper | Middle | Lower |
| Graphite artefact | | | | | | |
| CTE ($\times 10^{-6}$/° C) | | | | | | |
| 25-125° C | 0.19 | 0.19 | 0.19 | 0.50 | 0.34 | 0.33 |
| 100-400° C | 0.76 | 0.71 | 0.71 | 1.17 | 1.06 | 1.00 |
| CCE ($\times 10^{-6}$/° C) | | | | | | |
| 130-300° C | 6.85 | 6.66 | 6.52 | 8.32 | 8.00 | 7.75 |
| Maximum traversed magneto-resistance (%) | 19.9 | 19.8 | 19.9 | 11.2 | 12.1 | 13.4 |
| Calcined coke | | | | | | |
| Crushing strength (%) | 62.7 | 63.8 | 63.2 | 40.3 | 56.3 | 60.5 |

What we claim is:

1. A process for the production of a petroleum coke of unusually high-crystalline texture and of a high purity from a petroleum starting material having a low sulfur content and suitable for the production of premium grade coke which comprises the steps of:

subjecting the starting material to heat treatment to remove non-crystalline substances contained therein as pitch or coke and to form a heavy oil fraction of the starting material;

heating a heavy oil fraction of the starting material derived from the preceding stage to a temperature required for the subsequent coking;

continuously introducing the preheated oil with downward injection into a vertical, pressure coking-crystallizer, which is provided with a heating jacket surrounding the body thereof, a first injection nozzle at the upper part thereof for downwardly injecting the preheated oil and a second injection nozzle at the lower part thereof for upwardly injecting a purging gas;

maintaining said crystallizer at a coking temperature whereby gaseous light hydrocarbons are formed either by evaporation or by reactions of the oil introduced and whereby the remaining pitch-like heavy oil flows downwardly and is progressively accumulated and coked;

discharging, during coking, gaseous light hydrocarbons through an outlet positioned at the upper part of the crystallizer introducing, during coking, a small amount of a heated purging gas through said second injection nozzle into said crystallizer at a slow rate capable of preventing the clogging of the gas injection nozzle, thereby conducting the coking with a high growth and high orientation of coke crystals formed until the coke accumulated in the crystallizer reaches near said first injection nozzle;

terminating the introduction of preheated oil into the crystallizer;

increasing the amount of the purging gas flow to expel remaining oily materials; and removing the coke from the crystallizer.

2. A process as claimed in claim 1 wherein the heat treatment of the starting material is carried out in the presence of a small amount of a basic compound selected from the group consisting of hydroxides and carbonates of alkali and alkaline-earth metals.

3. A process as claimed in claim 2 wherein the basic compound is selected from the group consisting of sodium hydroxide and sodium carbonate.

4. A process as claimed in claim 2 wherein the basic compound is present in an amount of 0.5-10% by weight based on the starting material.

5. A process as claimed in claim 1 wherein the heat treatment is carried out by heating the starting material in a tube heater at a temperature of 430° to 520° C under a pressure of 4 to 20 kg/cm$^2$G for 30 to 500 seconds followed by subjecting the material to flash distillation to remove non-crystalline substances contained therein as pitch.

6. A process as claimed in claim 1 wherein the heat treatment is carried out by heating the starting material in a tube heater at a temperature of 430° to 520° C under a pressure of 4 to 20 kg/cm$^2$G for 30 to 500 seconds followed by subjecting the material to a delayed coking to remove non-crystalline substances contained therein as coke.

7. A process as claimed in claim 1 wherein the coking in the coking crystallizer is carried out at a temperature of 410° to 500° C under a pressure of 4 to 20 kg/cm$^2$G.

8. A process as claimed in claim 1 wherein a gas oil fraction derived as by-product from a coking process is heat treated so as to effect a thermal cracking thereof to give a heavy residue which is introduced as petroleum starting material to the coking crystallizer.

9. A process as claimed in claim 8 wherein the gas oil fraction is one derived from the coking stage of the process of claim 12.

10. A petroleum coke of unusually high-crystalline texture and of high purity which has a value of maximum traversed magnetoresistance of at least 16% as produced by the process of claim 1.

11. A process as claimed in claim 1 wherein said petroleum starting material is selected from the group consisting of low sulfur crude oil, distillation residuum, and cracked residuum.

* * * * *

UNITED STATES PATENT AND TRADEMARK OFFICE

CERTIFICATE OF CORRECTION

PATENT NO. : 4,040,946

DATED : August 9, 1977

INVENTOR(S) : Hayashi et al

It is certified that error appears in the above-identified patent and that said Letters Patent are hereby corrected as shown below:

--Cancel claim 10--

On the Cover sheet, "11 claims" below the abstract should read -- 10 claims--

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*